US006351852B1

(12) United States Patent
Propp

(10) Patent No.: US 6,351,852 B1
(45) Date of Patent: Mar. 5, 2002

(54) HEAD-CLEANSING CAP AND METHOD

(75) Inventor: Donald J. Propp, Dewitt, MI (US)

(73) Assignee: Tri-State Hospital Supply Corporation, Howell, MI (US)

( * ) Notice: Subject to any disclaimer, the term of this patent is extended or adjusted under 35 U.S.C. 154(b) by 0 days.

(21) Appl. No.: 09/727,058

(22) Filed: Nov. 29, 2000

(51) Int. Cl.[7] ..... A42B 1/18

(52) U.S. Cl. ..... 2/174; 2/171.2; 132/200; 132/221

(58) Field of Search ..... 2/171.2, 171.04, 2/181, 209.14, 174, 200.1; 132/200, 212, 221, 270, 272, 319

(56) References Cited

U.S. PATENT DOCUMENTS

| | | | | |
|---|---|---|---|---|
| 2,424,129 A | | 7/1947 | Vincelle | |
| 2,507,386 A | | 5/1950 | Spiegel | |
| 2,781,764 A | | 2/1957 | Miller | |
| 2,858,834 A | * | 11/1958 | Givens | 2/174 |
| 3,088,469 A | | 5/1963 | Berryhill et al. | |
| 3,261,027 A | | 7/1966 | Lambert | |
| 3,320,682 A | | 5/1967 | Sliman | |
| 3,954,113 A | | 5/1976 | Bohrer et al. | |
| 4,289,150 A | * | 9/1981 | Kimball | 132/7 |
| 4,296,763 A | | 10/1981 | Priest et al. | |
| 4,683,596 A | | 8/1987 | Cole | |
| 5,265,278 A | | 11/1993 | Watanabe | |
| 5,850,636 A | | 12/1998 | Reuven | |
| 6,026,822 A | * | 2/2000 | Skiba et al. | 132/212 |
| 6,047,706 A | * | 4/2000 | Skiba et al. | 132/200 |

* cited by examiner

*Primary Examiner*—John J. Calvert
*Assistant Examiner*—Katherine Moran
(74) *Attorney, Agent, or Firm*—Fildes & Outland, P.C.

(57) ABSTRACT

A head-cleansing cap having an outer fluid-impervious layer and an inner fluid-holding layer that is equal to or greater than the size of the outer layer. The outer fluid-impervious layer has a peripheral edge defining an opening for receiving a person's head. The inner layer is connected to the outer layer along the peripheral edge of the outer layer and may also be connected to the outer layer at one or more points spaced away from the peripheral edge of the outer layer. The inner layer is saturated with a rinse-free cleaning solution. In use, the head is massaged through the cap to release the cleaning solution onto the head of the user.

15 Claims, 1 Drawing Sheet

HEAD-CLEANSING CAP AND METHOD

FIELD OF THE INVENTION

This invention relates to personal hygiene, and in particular to a self-contained rinse-free head-cleansing cap and method for using the same.

BACKGROUND OF THE INVENTION

In the health care industry, caregivers find it particularly challenging to wash or bathe patients who are confined to a bed or wheelchair. Likewise, patients who are recovering from surgery, for example, or who are otherwise unable to stand without assistance are often unable to bathe or shower. One of the most difficult tasks for these patients is shampooing their own hair since shampooing traditionally requires rinsing the hair with running water.

One solution to this problem, is to provide these patients with a head bathing arrangement comprising a shower-cap type device with an inner lining. The exterior layer of the cap is made of a fluid-impervious material, like a conventional shower cap, while the inner lining is made from a fluid-absorbent material. The inner lining is impregnated with a suitable cleaning solution that is released when the head and hair are massaged through the cap.

The prior art, however, teaches that the inner lining of the cap must be smaller in dimension than the cap. This is disadvantageous in that less fluid and less surface area are available for cleaning the hair. This is particularly disadvantageous where a patient has long or thick hair. Moreover, the prior art teaches that the lining and the cap are bound to one another only along the peripheral edge of the cap. Thus, when the cap is massaged, the exterior cap moves over the head relative to the inner lining, but the inner lining does not readily slide through the hair or over the person's head.

SUMMARY OF THE INVENTION

The present invention provides a head-cleansing cap that solves the disadvantages of prior art head-cleansing caps by including an inner, fluid-holding layer and an outer fluid-impervious layer which are not only bound together about the peripheral edge of the outer layer but also at one or more points spaced away from the peripheral edge of the outer layer. Furthermore, the present invention teaches an inner fluid-holding layer which is equal to or greater than the size of the outer layer to provide more cleaning surface and more fluid to the user, resulting in more thorough and efficient head-cleansing.

According to the present invention, the outer fluid-impervious layer has a peripheral edge which defines an opening in the cap. The opening is adjustably sized to fit comfortably about the user's head. An inner fluid-holding layer is bound to the outer layer about the periphery of the outer layer. The inner fluid-holding layer is saturated with a rinse-free cleansing solution suitable for safely and effectively cleaning the user's hair and scalp. The inner fluid-holding layer is at least, if not greater than, the size of the outer fluid-impervious layer, thereby advantageously providing a generous amount of cleaning fluid and usable surface area. The inner layer is made of fluid-absorbent material capable of holding, releasing and reabsorbing the released fluid and may further comprise a plurality of sub-layers with like characteristics.

In addition to being connected about the peripheral edge of the outer layer, the inner and outer layers are further connected at at least one point a distance away from the peripheral edge of the outer layer. Preferably, the outer and inner layers are connected at a point at or near the center of the outer layer. Connecting the inner and outer layers together at a distance from the peripheral edge of the outer layer, is advantageous in that the inner layer moves with the outer layer and slides over the user's head, cleansing the hair and scalp when the cap is massaged. The larger surface area of the inner layer facilitates more thorough cleansing of the hair since the inner layer may be massaged through the hair.

The present invention is also directed to a method of using the head-cleansing cap previously described. The cap of the present invention is placed on the user's head though the opening defined by the peripheral edge of the outer layer. Next, the head and hair are massaged through the cap. Massaging the cap causes the cleaning solution to be released from the inner fluid-holding layer onto the user's head. The inner fluid-holding layer reabsorbs any fluid that does not evaporate. After the cleaning process is complete, the cap is simply removed and discarded. The cleaning solution does not require rinsing. The hair may be dried or permitted to air dry.

These and other features and advantages of the invention will be more fully understood from the following detailed description of the invention taken together with the accompanying drawings.

DETAILED DESCRIPTION OF THE INVENTION

Figure 1:
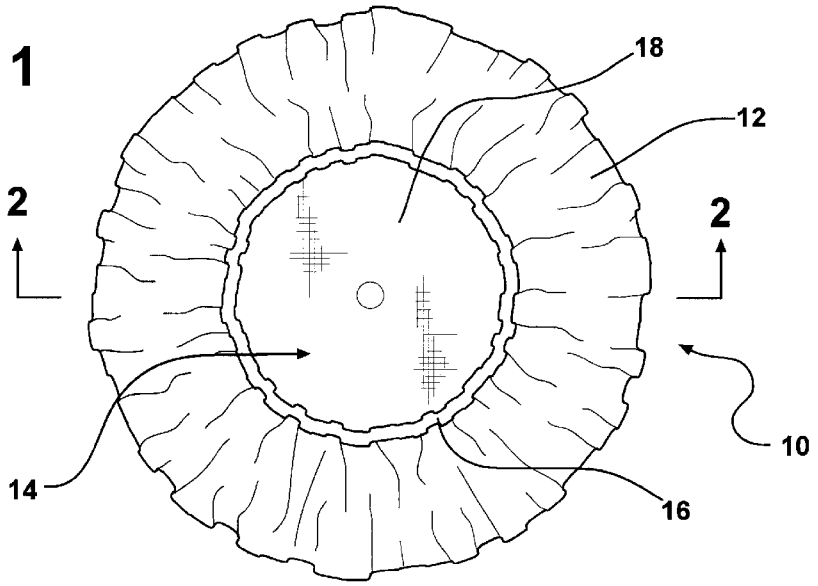
FIG. 1 is a lower plan view of a head-cleansing cap according to the present invention.

Referring now to the drawings in detail, numeral 10 generally indicates the head-cleansing cap of the present invention. The cap is comprised of an outer layer 12 and an inner layer 14. The outer layer is preferably made from a thin, fluid-impervious material such as polyethylene. The inner layer is a fluid-holding layer and may be comprised of any material capable of holding, releasing and reabsorbing fluid.

The inner layer is saturated with any rinse-free cleaning solution suitable for safely and effectively cleaning the hair and scalp. Accordingly, a preferred embodiment of the present invention includes an inner fluid-holding layer impregnated with a fluid containing water, idopropynyl butylcarbamate, propylene glycol, phenoxyethanol and ethylparaben and methylparaben and proplyparaben and butylparaben, DMDM Hydantoin, decyl glucoside, fragrance, allatoin, and dimethicone.

Figure 3:
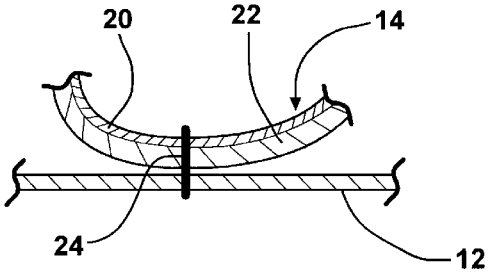
FIG. 3 is an enlarged cross-sectional showing of the inner fluid-holding layer and the outer fluid-impervious layer of the cap.

As best shown in FIG. 3, the inner fluid-holding layer, according to a preferred embodiment, is further comprised of a plurality of sublayers including a first sub-layer 20 and a second sub-layer 22. Preferably, the first sub-layer 20 is made of a material known as spunlace while the second sub-layer 22 is made of a material known as spunbond. Spunbond is made of polypropylene. The second sub-layer 22 may also be laminated, and in a preferred embodiment it is laminated with polyethylene.

Figure 2:
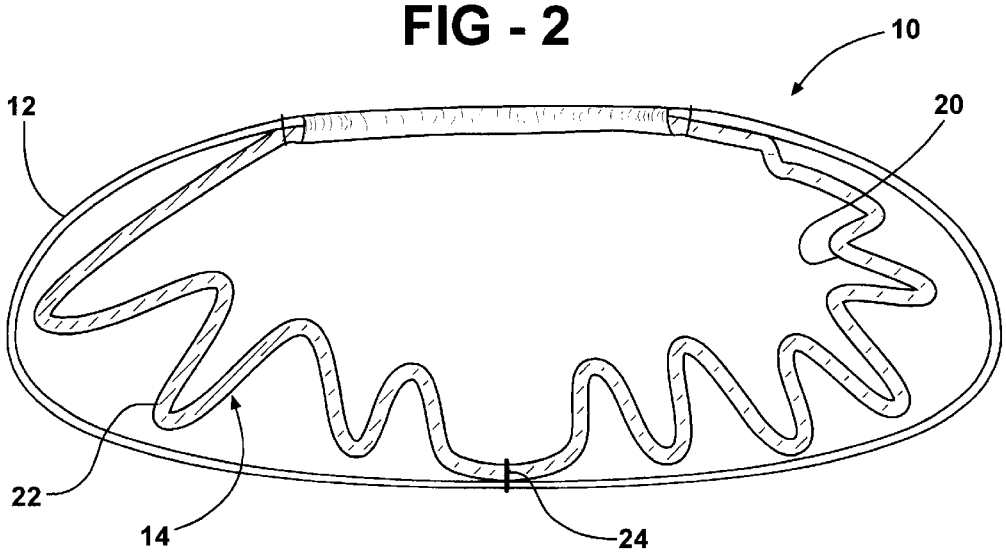
FIG. 2 is a cross-sectional view of the head-cleansing cap from the line 2—2 of FIG. 1.

FIGS. 1 and 2 show the outer layer having a peripheral edge 16 which defines an opening 18. The opening 18 is adjustably sized to fit about a person's head. In a preferred embodiment, an elastic band (not shown) is sewn about the peripheral edge of the cap. The inner layer 14 is bound to the outer layer about the peripheral edge 16. The size of the inner layer 14 is equal to or greater than the size of the outer layer 12. A preferred embodiment of the invention includes an inner layer approximately 20% greater than the size of the outer layer. An inner layer which is equal to or greater than the size of the outer layer not only permits a greater amount of cleaning solution to be applied to the user's head, it facilitates a more thorough cleaning of the head and scalp since more surface area is available to clean the hair.

The outer layer 12 and inner layer 14 are further connected to one another at one or more points spaced a distance away from the outer layer peripheral edge 16. In a preferred embodiment, the outer layer 12 and inner layer 14 are connected together at the center 24 of the outer layer. Connecting the outer and inner layers together at one or more points spaced from the peripheral edge of the outer layer permits the inner layer to readily slide relative to the user's head resulting in more thorough cleansing. Absent additional connection points between the outer and inner layers within the peripheral edge of the outer layer, the outer layer merely slides relative to the inner layer, in which case, the inner layer might not move over the scalp and through the hair.

In use, the cap 14 is fit snuggly about a person's head. The person's hair and scalp are massaged through the cap 14 with enough force to release the cleaning solution contained in the inner fluid-holding layer 14. The inner fluid-holding layer 14 reabsorbs any fluid that does not evaporate. Upon completion of the cleansing process, about 2 minutes, the cap is simply removed and discarded; no rinsing is required. The cap may also be heated in a microwave for a short period of time (15 seconds) for the user's added comfort.

Although the invention has been described by reference to a specific embodiment, it should be understood that numerous changes may be made within the spirit and scope of the inventive concepts described. Accordingly, it is intended that the invention not be limited to the described embodiment, but that it have the full scope defined by the language of the following claims.

What is claimed is:

1. A head-cleansing cap, comprising:

an outer fluid-impervious layer having a peripheral edge defining an opening for receiving a person's head;

an inner fluid-holding layer bound to the outer fluid-impervious layer about the peripheral edge of the outer layer;

said inner fluid-holding layer being at least as great as the size of the outer layer and said inner fluid-holding layer is further connected to said outer layer at least one point spaced from the peripheral edge of the outer layer; and said inner fluid-holding layer is further connected to said outer layer at at least one point spaced from the peripheral edge of the outer layer.

2. The head-cleansing cap of claim 1, wherein the inner fluid-holding layer is saturated with a rinse-free cleaning solution.

3. The head-cleansing cap of claim 1, wherein the at least one point spaced apart from the peripheral edge of the outer layer includes a point at the center of the outer layer.

4. The head-cleansing cap of claim 1, wherein the outer layer is comprised of polyethylene.

5. The head-cleansing cap of claim 1, wherein the inner layer is comprised of polypropylene.

6. The head-cleansing cap of claim 5, wherein the polypropylene is laminated with polyethylene.

7. The head-cleansing cap of claim 1, wherein the size of the inner fluid-holding layer is 20% greater than the size of the outer layer.

8. A head-cleansing cap, comprising:

an outer fluid-impervious layer having a peripheral edge defining an opening for receiving a person's head;

an inner fluid-holding layer bound to the outer fluid-impervious layer about the peripheral edge of the outer layer;

said inner fluid-holding layer being at least as great as the size of the outer layer; and wherein the inner fluid-holding layer is comprised of a plurality of layers, each one of said plurality of layers being connected to the outer layer of the cap at a point away from the peripheral edge of the outer layer; and wherein the inner fluid-holding layer is comprised of a plurality of layers, each one of said plurality of layers being connected to the outer layer of the cap at a point away from the peripheral edge of the outer layer.

9. The head-cleansing cap of claim 8, wherein one of said plurality layers is a layer of spunlace.

10. The head-cleansing cap of claim 8, wherein one of said plurality layers is a layer of spunbond.

11. A head-cleansing cap, comprising:

an outer fluid-impervious layer having a peripheral edge defining an opening for receiving a person's head;

an inner fluid-holding layer which is at least the size of the outer layer;

said inner layer being further connected to said outer layer along the peripheral edge of the outer layer and at at least one point spaced from the peripheral edge of the outer layer so that the inner layer is slidable relative to the person's head.

12. The head-cleansing cap of claim 11, wherein said at least one point of further connection is the center of the outer layer.

13. The head-cleansing cap of claim 11, wherein the inner layer is formed of a plurality of layers, each layer being connected to said outer layer at a point spaced away from the peripheral edge of the outer layer.

14. The method of cleansing a person's hair and scalp, comprising the steps of:

providing a head cleansing cap with an outer fluid-impervious layer having a peripheral edge defining an opening for receiving the person's head;

providing an inner fluid-holding layer which is at least the size of the outer layer;

said inner layer being connected to said outer layer at least one point spaced apart from the peripheral edge of the outer layer;

connecting the inner layer to the outer layer along the peripheral edge of the outer layer;

fitting the cap onto a person's head;

massaging the person's hair and scalp through the cap so that the inner layer slides relative to the person's head and relative to the outer layer thereby releasing fluid held within the inner layer.

15. The method of claim 14, wherein the inner fluid-holding layer is comprised of a plurality of layers, each one of said plurality of layers being connected to the other layer of the cap at at least one point spaced apart from the peripheral edge of the outer layer.

* * * * *

UNITED STATES PATENT AND TRADEMARK OFFICE

CERTIFICATE OF CORRECTION

PATENT NO. : 6,351,852 B1
DATED : March 5, 2002
INVENTOR(S) : Donald J. Propp

It is certified that error appears in the above-identified patent and that said Letters Patent is hereby corrected as shown below:

Column 3,
Lines 52 thru 54, delete the first recitation of "and said inner fluid-holding layer is further connected to said outer layer at least one point spaced from the peripheral edge of the outer layer".

Column 4,
Lines 13 thru 17, delete the first occurrence of "wherein the inner fluid-holding layer is comprised of a plurality of layers, each one of said plurality of layers being connected to the outer layer of the cap at a point away from the peripheral edge of the outer layer; and".
Line 51, after "at" add the word -- at --.

Signed and Sealed this

Eleventh Day of June, 2002

*Attest:*

*Attesting Officer*

JAMES E. ROGAN
*Director of the United States Patent and Trademark Office*